United States Patent [19]

Lambert

[11] Patent Number: 4,732,402

[45] Date of Patent: Mar. 22, 1988

[54] WHEELCHAIR FOR A DISABLED PERSON, PARTICULARLY A CHILD

[75] Inventor: Jean-Pierre Lambert, Saint-Cyr-sur-Loire, France

[73] Assignee: Establissements POIRIER, Luynes, France

[21] Appl. No.: 905,660

[22] Filed: Sep. 11, 1986

[30] Foreign Application Priority Data

Sep. 13, 1985 [FR] France ..... 85 13586

[51] Int. Cl.[4] ..... A61G 5/02

[52] U.S. Cl. ..... 280/242 WC; 297/DIG. 4

[58] Field of Search ..... 280/242 WC, 242 R, 47.38; 297/DIG. 4

[56] References Cited

U.S. PATENT DOCUMENTS

| | | | |
|---|---|---|---|
| 1,687,812 | 10/1928 | Weber | 280/242 WC |
| 3,901,527 | 8/1975 | Danziger et al. | 280/242 WC |
| 4,405,142 | 9/1983 | Whetstine | 280/242 WC |
| 4,506,901 | 3/1985 | Tosti | 280/242 WC |

*Primary Examiner*—John J. Love
*Assistant Examiner*—Donn McGiehan
*Attorney, Agent, or Firm*—Roylance, Abrams, Berdo & Goodman

[57] ABSTRACT

The wheelchair according to the invention comprises a frame (1) provided, on each longitudinal side thereof, with a propelling assembly including an arm (6) carrying a driving wheel (2) and a hand wheel (3) at its ends as well as a transmission means (8–10) connecting the driving wheel (2) to the hand wheel (3).

It it characterized in that the propelling assemblies form removable assemblies disposed on the longitudinal sides of the frame (1).

The arms (6) of the propelling assemblies are pivotally mounted on supports (7) attached on the longitudinal sides of the frame (1), while locking means (14) are provided to secure them on the supports (7) in any of a plurality of predetermined positions to adjust the position of the hand wheels according to the size of the disabled.

11 Claims, 4 Drawing Figures

WHEELCHAIR FOR A DISABLED PERSON, PARTICULARLY A CHILD

The present invention relates to a wheelchair for a disabled person, particularly a child, comprising a frame provided, on each longitudinal side thereof, with a propelling assembly including an arm carrying a driving wheel and a hand wheel at its ends as well as a transmission means connecting the driving wheel to the hand wheel.

The hand wheels of the manually-propelled wheelchairs are currently located in the close vicinity of the rear wheel bands. However, when the disabled person propels her wheelchair on a wet or dirty ground, she may spoil the lower extremity of her cloth sleeves at every moment.

The present invention is directed to remedy such a disadvantage and, to this effect, it is an object of the invention to provide a wheelchair of the above mentioned type, characterized in that the propelling assemblies form removable assemblies disposed on the longitudinal sides of the frame.

This set of provisions allows to space the hand whells away from the driving wheels and thus avoids that the disabled person get soiled when propelling her wheelchair on a wet or muddy ground.

Additionally, having the arms, driving wheels and hand wheels forming assemblies adjustably mounted on the longitudinal sides of the frame makes it possible to noticeably simplify the wheelchair manufacturing and mounting operations.

In a particular embodiment of the invention, the arms of the propelling assemblies are pivotally mounted on supports attached on the longitudinal sides of the frame, while locking means are provided to secure them on the supports in any of a plurality of predetermined positions.

The elevation of the hand wheel can thus be varied according to the size of the disabled person, which allows to reduce at best the efforts she has to make for her displacement.

The wheelchair according to the invention is more particularly useful for children since its hand wheels can be adjusted in elevation as the former are growing.

Preferably, the locking means consist of nut-bolt assemblies inserted in holes provided in the arms and supports, the arms, alternatively the supports, comprising a single hole, whereas the supports, alternatively the arms, comprise a plurality of holes distributed over an arc of a circle centered on the pivot pin of the arms.

In this case, the elevational adjustment of the hand wheels can thus be achieved by inserting the nut-bolt assemblies in the hole provided in the arms, alternatively the supports, as well as in a predetermined one of the plurality of holes formed in the supports, alternatively the arms.

Advantageously, the arm supports are movable along the longitudinal sides of the frame.

By changing the position of the supports, it is thus possible to adjust the position of the hand wheels along the longitudinal sides of the frame so that the disabled person has still less effort to make to move her wheelchair.

According to a particular feature of the invention, the ends of the arms carrying the driving wheels are, preferably, located at the rear of the frame.

The above and further objects, details and advantages of the present invention will become apparent from the following description of an embodiment thereof, when read in conjunction with the accompanying drawings, in which.

Figure 1:
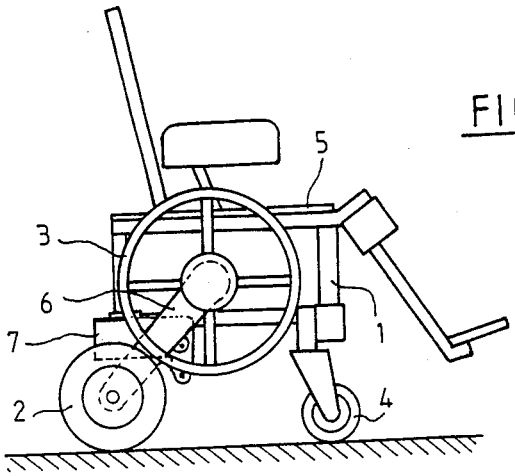
FIG. 1 is a schematic side view of a wheelchair according to the invention.

Referring to the drawings, the wheelchair comprises a frame 1 provided, on each longitudinal side thereof, with a driving wheel 2, a hand wheel 3 able to rotate the corresponding driving wheel when rotatably driven, and a steering wheel 4.

The driving wheels 2 and steering wheels 4 are respectively located at the rear and front of the frame. The hand wheels 3 are placed between the driving wheels and the steering wheels so as to be easily accessible for a disabled person sitting on the seat 5 supported on the frame 1.

As illustrated by the drawings, the hand wheels are circular in shape and their diameter is substantially larger that the diameter of the frame wheels. They are in fact formed with a large diameter so that the disabled peron can move the wheelchair with the least possible effort.

The driving wheels 2 and hand wheels 3 are rotatably mounted at the ends of two arms 6 (of which only one is shown on the drawings) carried by supports 7 attached on the longitudinal sides of the frame.

The arms 6 are hollow and respectively enclose an endless chain 8 laid tight between a pair of toothed wheels 9, 10 respectively fixed on the axles of the corresponding driving wheel 2 and hand wheel 3.

It is to be understood that the endless chains 8 and toothed wheels 9 and 10 might be replaced by equivalent transmission means allowing to link the driving wheels 2 and the hand wheels 3 located on a same side of the frame without departing from the scope of the present invention.

The arms 6 are provided with a bracket 11 in the vicinity of the rearward end of their upper side and with a bracket 12 substantially in the middle of their lower side. They are pivoted on a pin 13 integral with the corresponding support 7, said pin being inserted in a bore formed in their bracket 11. Moreover, they are fastened on the corresponding support 7 by means of a nut-bolt assembly 14 inserted in a bore provided in their bracket 12 as well as in one of the bores 15 formed in the corresponding support over an arc of a circle centered on pin 13.

Figure 4:
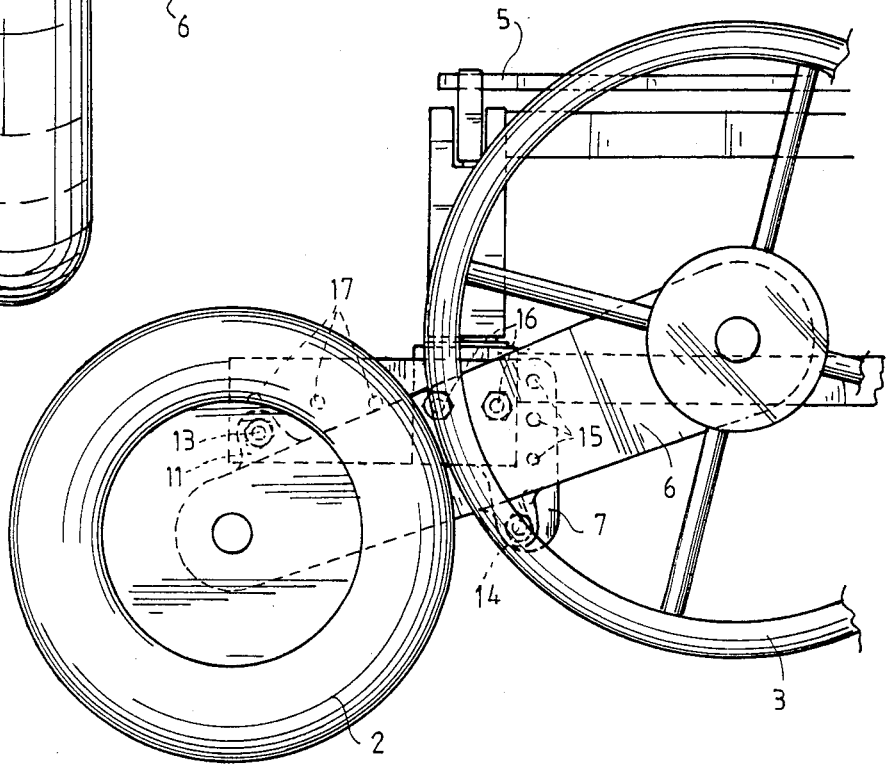
FIG. 4 is a view similar to FIG. 2, but showing the hand wheel in its lower- and rearmost positions.

It can be easily appreciated that the elevation of the hand wheels can be varied by pivoting the arms 6 about the pins 13 and inserting the nut-bolt assemblies 14 in other bores 15 in order to secure the arms 6 in the desired inclined position. Referring to FIG. 4, it will be noted, for example, that the hand wheel is in its lower most position, the nut-bolt assembly 14 as shown on this figure being inserted in the lowest bore 15.

Of course, forming a single bore in the supports 7 and several bores in the arms 6, with the bores in said arms being distributed over an arc of a circle centered on pins 13, would be within the scope of the present invention.

The same would evidently apply if, for example, the pivot pins of the arms 6 were provided at the bracket 12, and the bores 15 at the bracket 11 thereof.

Figure 3:
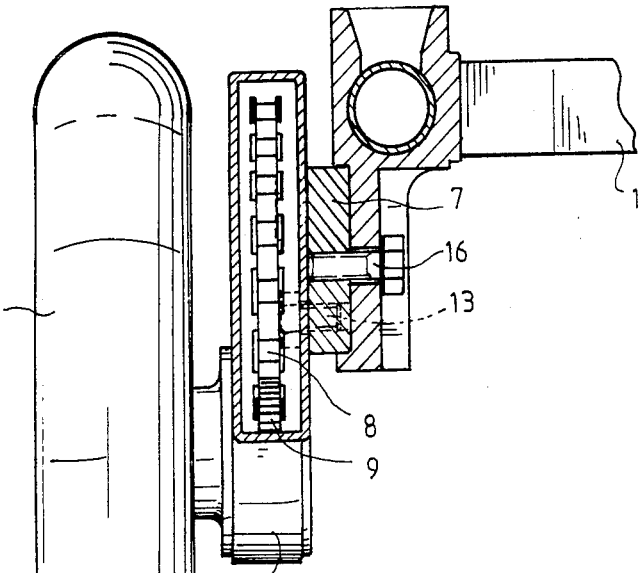
FIG. 3 is a sectional view taken along line III—III of FIG. 2.

Two bolts 16, the head of which is bearing against the internal face of a vertical wall of the frame and the barrel of which is extending through bores formed in said wall (see FIG. 3), are threaded into two tapped holes 17 formed in the corresponding support 7 and thus provide fastening of the latter on to the frame 1.

In the exemplary embodiment discussed above, each of the supports 7 is provided with five tapped holes 17 formed in such a manner that two successive holes can receive the bolts 16 selectively.

Figure 2:
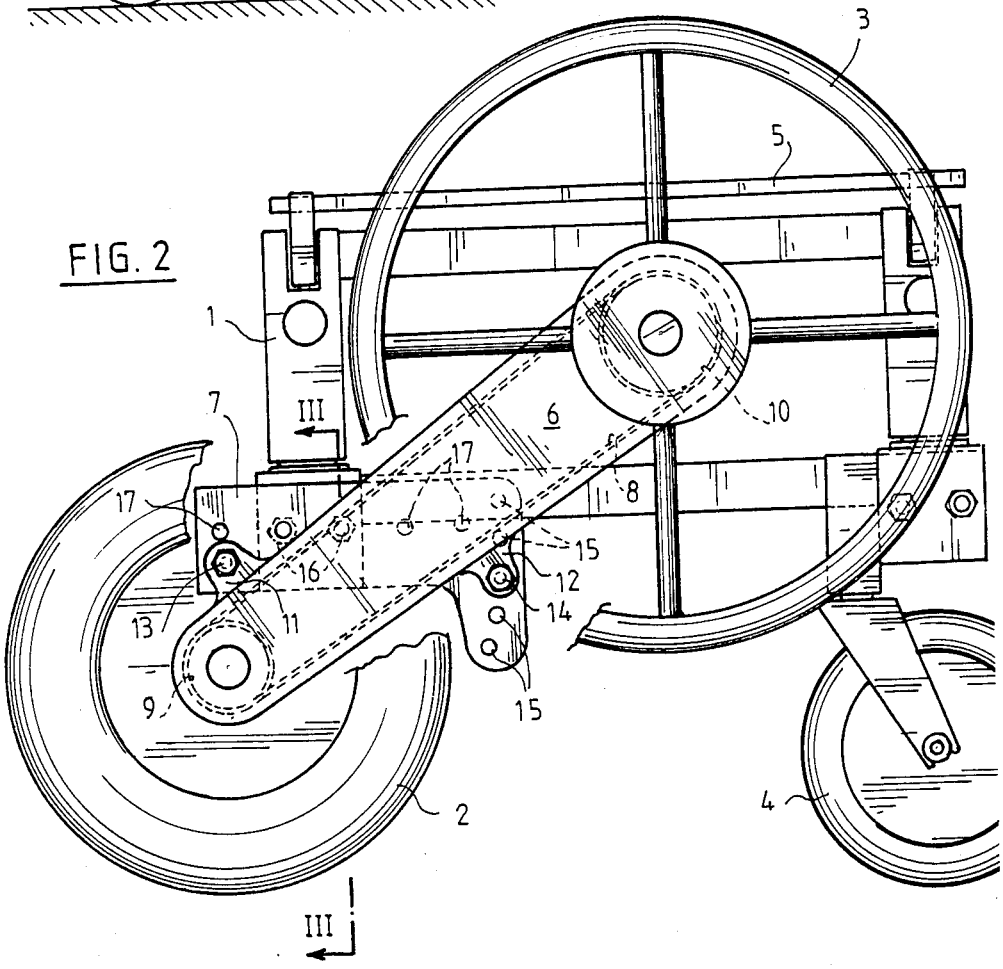
FIG. 2 is a partial enlarged view, with cutaway part, of the wheelchair shown on FIG. 1.

With this arrangement, it is thus also possible to move the hand wheels parallel to the longitudinal sides of the frame 1. To illustrate this, FIG. 2 shows the hand wheel 3 at the position where it stands when the bolts 16 are inserted in the second and third tapped holes 17 from the left, whereas FIG. 4 shows the same at the position where it stands when the bolts 16 are inserted in the fourth and fifth tapped holes 17 from the left.

It will be clearly apparent from the foregoing description that the hand wheels of the wheelchair according to the present invention are adjustable in elevation and movable along the longitudinal sides of the frame so that the disabled person can move the wheelchair under the most favourable conditions.

What is claimed is:

1. A wheelchair for a disabled person, particularly a child, comprising:

a frame having opposite sides;

an independent propelling assembly on each of said sides, each said propelling assembly being formed as a unit and including an elongated arm pivotally mounted on a support on one of said sides of said frame and rotatably supporting a driving wheel at one end thereof engaging ground and a hand wheel at an opposite end thereof, transmission means coupling said driving wheel to said hand wheel for simultaneous rotation, adjustment means, coupled to said hand wheel, for varying height of said hand wheel relative to said frame, said driving wheel and the ground, and locking means, on each said support and each said arm, for securing each said arm in a plurality of predetermined positions; and coupling means for easily attaching each said propelling assembly to and removing each said propelling assembly from said sides of said frame.

2. A wheelchair according to claim 1 wherein said locking means comprise nut and bolt assemblies extending through holes in said arms and said supports.

3. A wheelchair according to claim 2 wherein said holes are distributed in each said support over an arc of a circle centered on a pivot axis of that arm.

4. A wheelchair according to claim 3 wherein said coupling means attach said supports to said sides of said frame and permit longitudinal movement of said supports along said longitudinal sides of said frame for varying longitudinal positions of said supports relative to said frame.

5. A wheelchair according to claim 4 wherein said coupling means comprise of bores in said supports and said frame and bolts selectively located in respective pairs of said bores.

6. A wheelchair according to claim 2 wherein said coupling means attach said supports to said sides of said frame and permit longitudinal movement of said supports along said longitudinal sides of said frame for varying longitudinal positions of said supports relative to said frame.

7. A wheelchair according to claim 6 wherein said coupling means comprise of bores in said supports and said frame and bolts selectively located in respective pairs of said bores.

8. A wheelchair according to claim 6 wherein said coupling means attach said supports to said sides of said frame and permit longitudinal movement of said supports along said sides of said frame for varying longitudinal positions of said supports relative to said frame.

9. A wheelchair according to claim 8 wherein said coupling means comprise of bores in said supports and said frame and bolts selectively located in respective pairs of said bores.

10. A wheelchair according to claim 1 wherein the ends of said arms, located at a rear of said frame, carry said driving wheel.

11. A wheelchair according to claim 1 wherein said coupling means comprise removable fasteners extending through openings in said frame.

* * * * *